US006546998B2

(12) United States Patent
Oh et al.

(10) Patent No.: US 6,546,998 B2
(45) Date of Patent: Apr. 15, 2003

(54) TUBE STRUCTURE OF MICRO-MULTI CHANNEL HEAT EXCHANGER

(75) Inventors: Sai Kee Oh, Seoul (KR); Dong Yeon Jang, Kyonggi-do (KR); Se Yoon Oh, Seoul (KR); Wook Yong Lee, Kyonggi-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/996,613

(22) Filed: Nov. 30, 2001

(65) Prior Publication Data

US 2002/0066554 A1 Jun. 6, 2002

(30) Foreign Application Priority Data

Dec. 1, 2000 (KR) ..... 00-72369

(51) Int. Cl.[7] ..... F28B 1/00; F28F 1/40

(52) U.S. Cl. ..... 165/110; 165/172; 165/151; 165/152

(58) Field of Search ..... 165/110, 146, 165/147, 177, 179, 183

(56) References Cited

U.S. PATENT DOCUMENTS

| | | | | | |
|---|---|---|---|---|---|
| 2,650,073 | A | * | 8/1953 | Holm | 165/140 |
| 4,570,700 | A | * | 2/1986 | Ohara et al. | 165/134.1 |
| 4,715,432 | A | * | 12/1987 | Paikert | 138/40 |
| 4,997,036 | A | * | 3/1991 | Schulze et al. | 165/151 |
| 6,343,645 | B1 | * | 2/2002 | Baumann et al. | 165/140 |

* cited by examiner

*Primary Examiner*—Allen Flanigan
(74) *Attorney, Agent, or Firm*—Birch, Stewart, Kolasch & Birch, LLP

(57) ABSTRACT

A micro-multi channel heat exchanger includes a lower header having a hollow for receiving refrigerant and an upper header opposite to the lower header. A plurality of tubes are arranged in a length direction of the upper and lower headers at fixed intervals, each having opposite ends fixed to the upper header and the lower header. A plurality of channels are formed in the tubes and elongated to be in communication with the hollows of the two headers. Each channel has an area of a section, parallel to a length direction of the two headers, reducing at a fixed ratio as the channels go from an air inlet side to an air outlet side. A plurality of fins are located between the tubes for heat exchange with the air.

20 Claims, 5 Drawing Sheets

TUBE STRUCTURE OF MICRO-MULTI CHANNEL HEAT EXCHANGER

BACKGROUND OF THE INVENTION

1. Field of the Invention

The present invention relates to a micro-multi channel heat exchanger. More particularly, the present invention relates to a tube structure of a micro-multi channel heat exchanger, in which a sectional area of a channel in a tube is changed for enhancing a heat transfer efficiency.

2. Background of the Related Art

The heat exchanger is applied to an air conditioner for heating or cooling a room temperature. A related art heat exchanger will be explained, with reference to FIGS. 1–3. FIG. 1 illustrates a disassembled perspective view of a related art heat exchanger, FIG. 2 illustrates a section across line I—I in FIG. 1, and FIG. 3 illustrates a graph showing a temperature change of flowing air vs. a tube plate surface temperature along a length of the tube plate in an air flowing direction in the section in FIG. 1.

Referring to FIGS. 1 and 2, the related art heat exchanger is provided with a lower hollow header 1, an upper header 2 positioned to correspond to the lower header 1, a plurality of tubes 4 between the upper header 2 and the lower header 1, and fins 6 between adjacent tubes. The hollow cylindrical lower header 1 has a plurality of header holes 3 in an outer circumference at fixed intervals along a length of the lower header 1 each for inserting and fixing a first end of the tube 4. The upper header 2 positioned opposite to the lower header 1 has the same shape, with the header holes 3 in the lower header 1 and the upper header 2 arranged to face each other. According to this, as the first end of the tube 4 is inserted in the header hole in the lower header 1, and a second end of the tube 4 is inserted in the header hole in the upper header 2, respective tubes 4 are arranged parallel along a length of the lower header 1 and upper header 2.

The tube 4 is rectangular, and has a width and a small thickness enough to be fitted to the two headers. A plurality of channels 5 are provided inside of the tube. The tube 4 has rounded entrance and exit sides for smooth air flow. There are a plurality of channels 5 elongated along a length of the tube arranged perpendicular to a direction of air flow, each having a fine section. The tube 4 is fixed to the two headers 1 and 2 at both ends thereof such that the hollows in the headers 1 and 2 are in communication with the channels 5. The fins 6, fitted between adjacent tubes 4, make heat exchange, while air passes therethrough. The fin 6 is a thin plate bent in a zigzag form. In the foregoing heat exchanger, a refrigerant, introduced into the hollow of the lower header 1, makes heat exchange with the air, as the refrigerant passes through the channels 5, and flows into the upper header 2.

However, the foregoing heat exchanger has the following problems.

Referring to FIG. 3, the refrigerant in the channels 5 evaporates as the refrigerant makes heat exchange with the air. The heat exchanger has a tube plate surface temperature of approx. 8° C. maintained even if the air has a temperature relatively higher than the heat exchanger. Even if the tube surface temperature shows a little variation with an environment, since the tube surface temperature is substantially constant, the tube surface temperature is assumed to be constant. Of course, it is understandable that a temperature of the air making heat exchange with a surface of the heat exchanger varies with the seasons or an environment. For example, if a room air temperature is 27° C., the heat exchanger has an inlet air temperature of 27° C., and an outlet air temperature, after heat exchange with the refrigerant, of 14° C. Therefore, a temperature difference between the air and a surface of the first channel at the inlet side is 19° C., and the temperature difference between the air and a surface of the first channel at the outlet side is 6° C.

Heat transfer between two bodies is proportional to a temperature difference and a contact surface area. Therefore, there is approximately three times the heat transferred at the inlet side channel of the tube 4, as compared to the heat transferred at the outlet side channel. Consequently, the refrigerant flowing through the inlet side channel vaporizes faster than the refrigerant flowing through the outlet side channel. In this instance, a refrigerant pressure in the upper header 2 is substantially uniform within the upper header 2, and a refrigerant pressure in the lower header 1 is substantially uniform within the lower header 1. As shown in FIG. 3, a curve showing the air temperature has a moderate slope at the air inlet side of the tube 4 and a steeper slope from a particular channel in the inlet side to the outlet channel, to form a convex curve overall.

As discussed, if refrigerant in the inlet side channel vaporizes faster than other channels, a flow resistance of the refrigerant is increased as a vapor phase region of the refrigerant in the inlet side channel increases. This reduces an amount of the refrigerant introduced into the inlet side channel from the lower header 1. According to this, the amount of heat transfer from the inlet side of the tube is reduced, showing the reduced air temperature drop at the inlet side as shown in FIG. 3. While the increase of vapor phase region caused by the vaporization of the refrigerant at the inlet side increases a pressure in the inlet side channel, the pressure in the outlet side channel decreases relatively, to cause a difference of pressure drops between the inlet side channel and the outlet side channel of the tube 4. In the meantime, since flow of the refrigerant in the heat exchanger system is changed by a characteristic of maintaining identical pressure drop all over the heat exchanger system, refrigerant is supplied to the outlet side more than the inlet side of the tube 4, making the pressure drops similar.

As discussed, since the amount of refrigerant in the inlet side channel is reduced due to the vapor phase region and the amount of refrigerant in the outlet side channel is increased, a width of the tube 4 in which an actual heat exchange occurs is reduced from an actual width of the tube 4 perpendicular to the air flow. Thus, formation of identical sectional areas of channels in the tube reduces an overall heat exchange efficiency of the heat exchanger.

SUMMARY OF THE INVENTION

Accordingly, the present invention is directed to a tube structure of a micro-multi channel heat exchanger that substantially obviates one or more of the problems due to limitations and disadvantages of the related art.

An object of the present invention is to provide a tube structure of a micro-multi channel heat exchanger, in which the whole heat exchanger is utilized more efficiently for enhancing a heat transfer efficiency.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the tube structure of a micro-multi channel heat exchanger includes a lower header having a hollow for receiving refrigerant, and an upper header having a shape the same as the lower header placed over, and opposite to the lower header. A plurality of tubes is arranged in a length direction of the upper and lower headers at fixed intervals each having opposite ends fixed to the upper header and the lower header. A plurality of channels are formed in the tubes and are elongated to be in communication with the hollows of the two headers each with an area of a section parallel to a length direction of the two headers reduced at a fixed ratio as it goes from an air inlet side to an air outlet side. A plurality of fins are located between the tubes for heat exchange with the air.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 4:
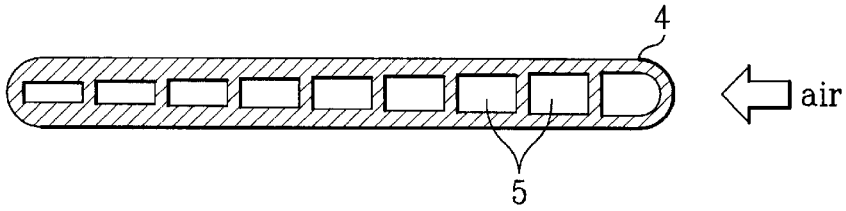
FIG. 4 illustrates a section of a tube parallel to an air flow direction in accordance with a preferred embodiment of the present invention.
Figure 5:
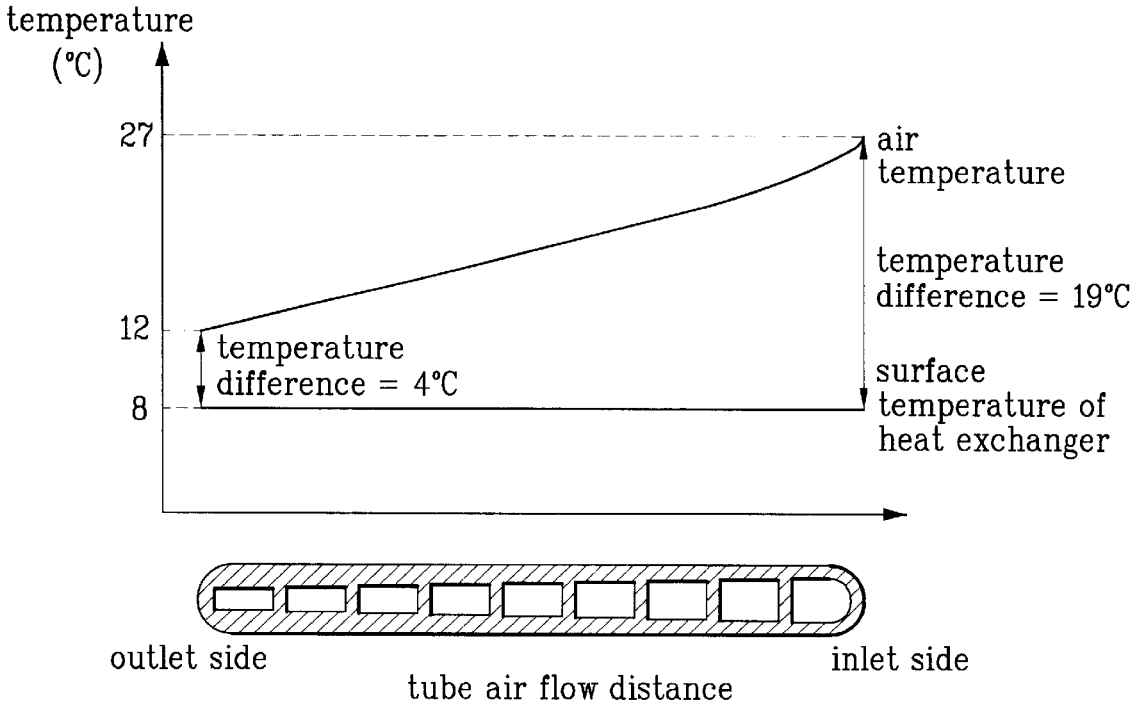
FIG. 5 illustrates a graph showing an air temperature change, and a surface temperature of a tube vs. a distance in an air flow direction in the section in FIG. 4.
Figure 6:
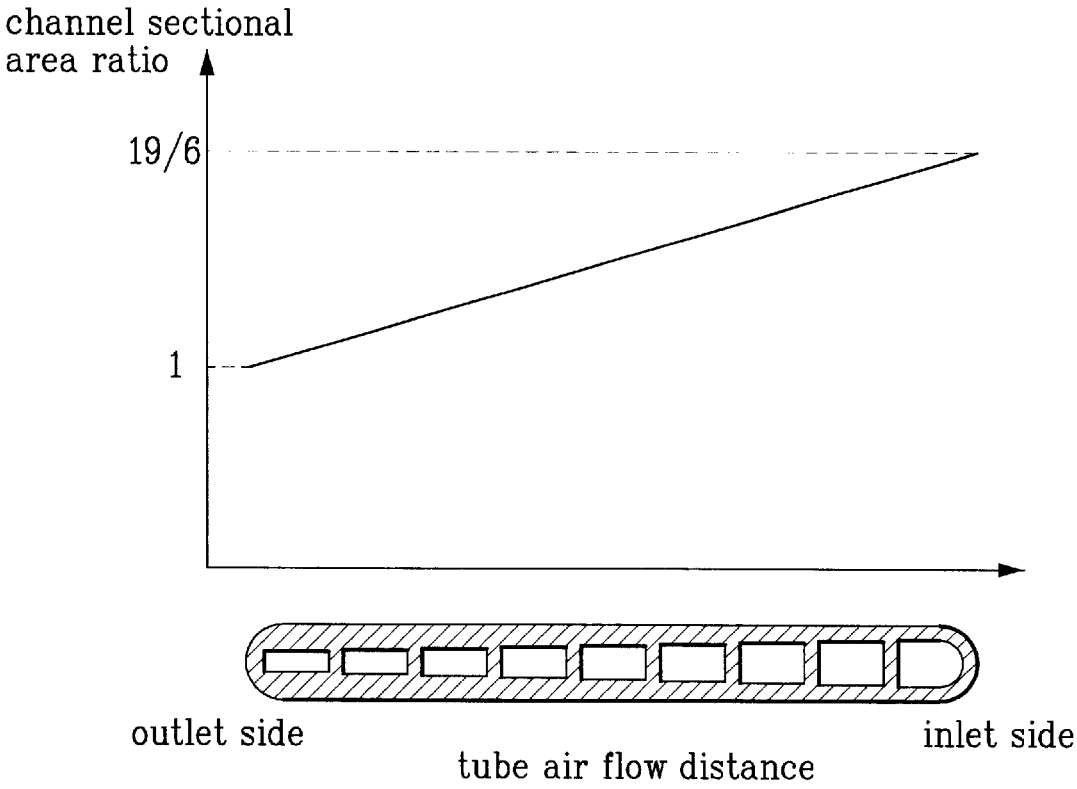
FIG. 6 illustrates a graph showing a sectional area ratio of channels vs. a distance in an air flow direction of the tube in the section in FIG. 4; and, FIG. 7 illustrates a section of a heat exchanger tube in accordance with another preferred embodiment of the present invention.

Reference will now be made in detail to the preferred embodiments of the present invention, examples of which are illustrated in the accompanying drawings. FIG. 4 illustrates a section of a tube parallel to an air flow direction in accordance with a preferred embodiment of the present invention. FIG. 5 illustrates a graph showing an air temperature change, and a surface temperature of a tube vs. a distance in an air flow direction in the section in FIG. 4. FIG. 6 illustrates a graph showing a sectional area ratio of channels vs. a distance in an air flow direction of the tube in the section in FIG. 4.

Referring to FIG. 4, each channel 5 has a cross sectional area taken parallel to length directions of the two headers 1 and 2. The sectional areas reduce in size at a fixed ratio from an inlet side to an outlet sider. The channel 5 has a rectangular section (FIG. 4) with a side parallel to the air flow longer than a side perpendicular to the air flow, or a trapezoidal section (FIG. 7) with a side on the inlet side greater than a side on the outlet side. It is preferable that corners of the section of the channel 5 are rounded for reduction of the flow resistance, or only an air inlet side of the first channel at the air inlet side of the tube, and/or only an air outlet side of the first channel at the air outlet side of the tube, may be rounded.

As a general principal, a heat exchange efficiency is proportional to a temperature difference and a contact area between two bodies. According to this, it is preferable that a section area of the channel 5 is reduced in a ratio of (an inlet side temperature difference)/(an outlet side temperature difference) as it goes from the inlet side to the outlet side, where the inlet side temperature difference is a temperature difference between a heat exchanger surface and the flowing air at the inlet side of the tube 4, and the outlet side temperature difference is a temperature difference between a heat exchanger surface and the flowing air at the outlet side of the tube 4.

Figure 1:
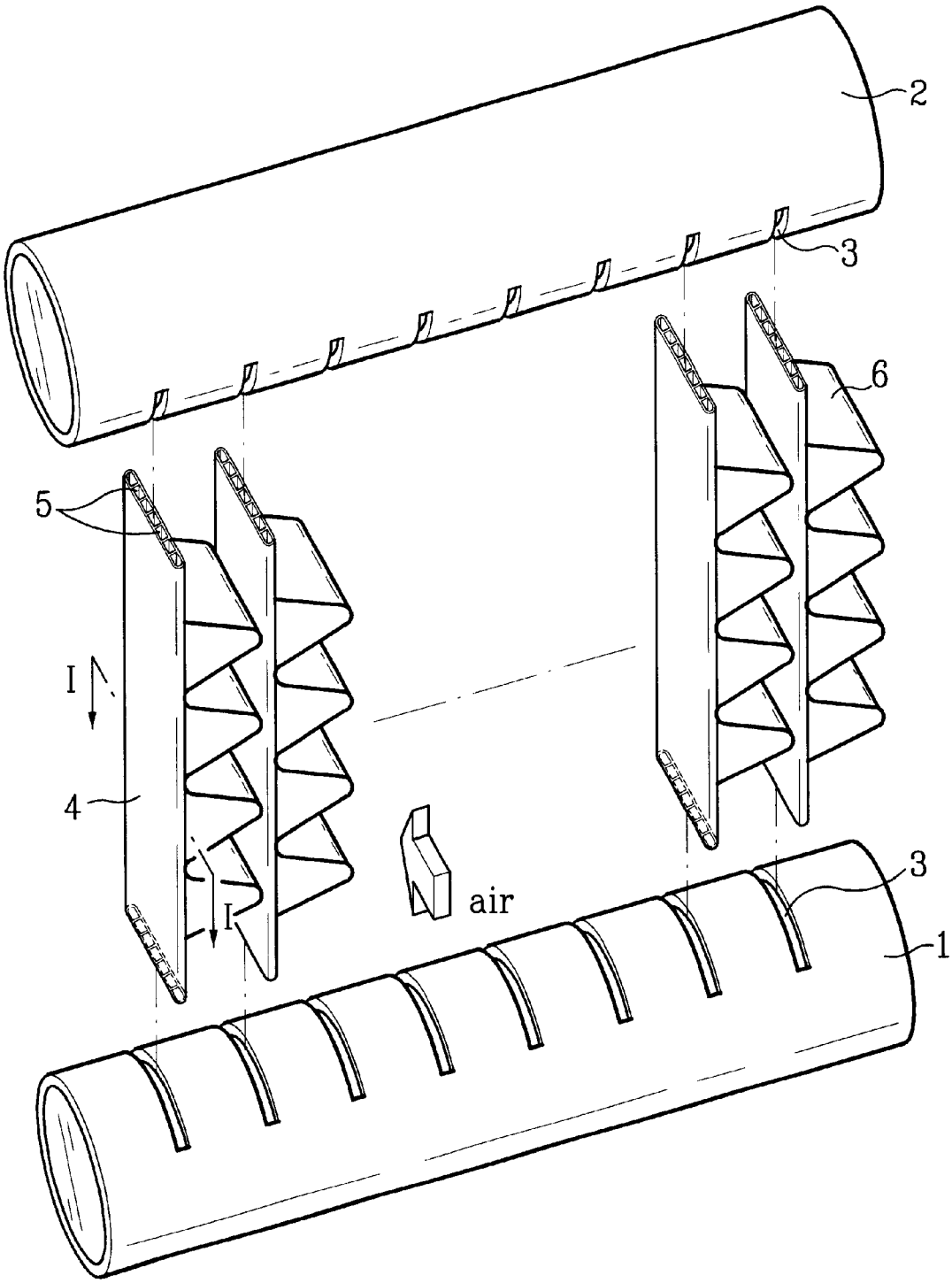
FIG.1 Prior Art
FIG. 1 illustrates a disassembled perspective view of a related art heat exchanger.
Figure 2:
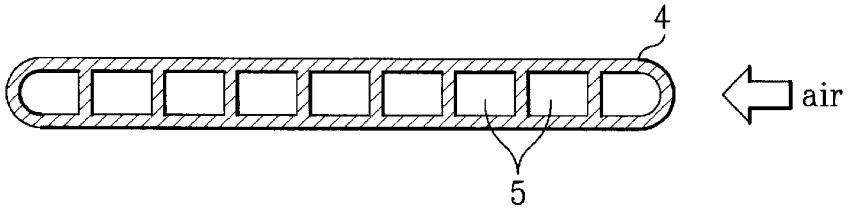
FIG. 2 Prior Art
FIG. 2 illustrates a section across line I—I in FIG. 1.
Figure 3:
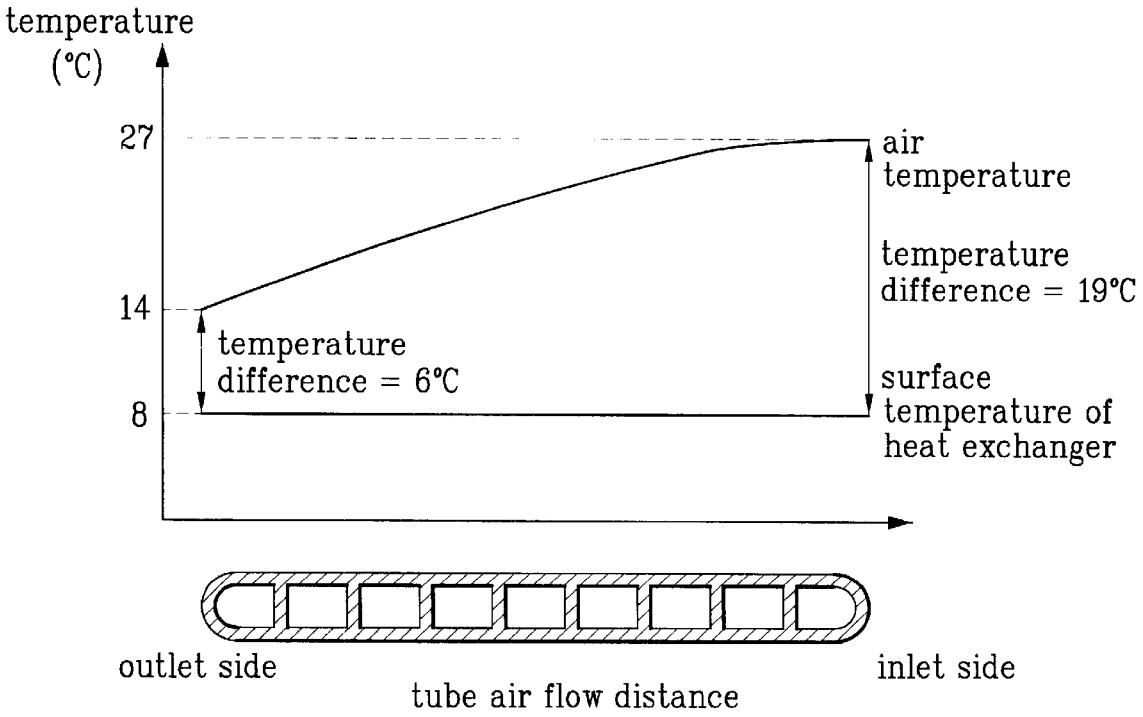
FIG. 3 Prior Art
FIG. 3 illustrates a graph showing an air temperature change, and a surface temperature of a tube vs. a distance in an air flow direction in the section in FIG. 1.

The case where the inlet side temperature difference of the tube 4 is 19° C; and the outlet side temperature difference of the tube 4 is 6° C., identical to the related art, will be taken as an example. As shown in FIG. 6, it is preferable that a ratio of an inlet side first channel sectional area to an outlet side first channel sectional area is set to be 19:6. That is, the inlet side first channel sectional area is set to be the same with the related art, and the outlet side first channel sectional area is set to be 6/19 times the area of the inlet side first channel sectional. Since the air temperature passing through the heat exchanger varies with regions and environments, the ratio of the sectional areas is set appropriately with reference to an average summer temperature of a particular region in which the heat exchanger is used, or an average temperature of a time zone in which the heat exchanger is used. However, the curve showing a temperature variation in FIG. 3 is substantially straight, the curve in FIG. 6 illustrating a variation of a sectional area ratio will be shown in a straight line for convenience.

The behavior of the heat exchanger of the present invention having the foregoing tube 4 with the foregoing sectional area ratio will be explained.

Referring to FIG. 5, when a room air temperature is 27° C. and a surface temperature of the heat exchanger is 8° C., a temperature difference between the surface temperature of the heat exchanger and the temperature of the air at the inlet side is 19° C. A temperature difference between the surface temperature of the heat exchanger and the temperature of the air at the outlet side is 4° C. In this instance, since the temperature difference at the inlet side is great, the sectional area of the inlet side channel is formed relatively large for increasing a flow rate of the refrigerant, and the sectional area of the channel is reduced as it goes from the inlet side channel to the outlet side channel, for reducing the flow rate. In conclusion, the flow rate of the refrigerant is relatively increased in the inlet side channel, having a great temperature difference, for causing more heat exchange at a part having a high heat exchange efficiency. The flow rate is relatively reduced in the outlet side channel having a small heat exchange efficiency, for causing a corresponding heat exchange.

Another embodiment of the present invention will be explained, with reference to FIG. 7.

Figure 7:
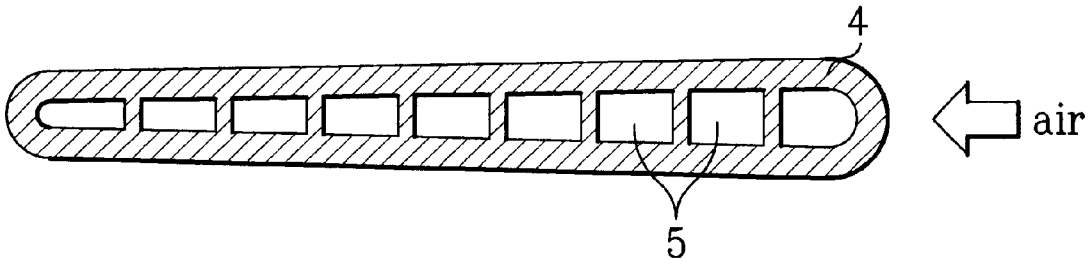

Referring to FIG. 7, a sectional area of the tube parallel to a length direction of the two headers 1 and 2 is reduced at a fixed ratio as it goes from an air inlet side to an air outlet side. Thus, the tube 4 forms a wedge on the whole, the inside of which includes a plurality of channels 5. The channels 5 are elongated to be in communication with the hollows of the two headers 1 and 2. An area of section of the channels, parallel to a length direction of the two headers, is reduced at a fixed ratio, as it goes from the air inlet side to the air outlet side. In this instance, a sectional area of each tube and a sectional area of each channel in each tube is reduced at a ratio of (inlet side temperature difference)/(outlet side temperature difference) as it goes from the air inlet side to the air outlet side. Since a channel structure of the foregoing tube of the heat exchanger is the same as before, the explanations will be omitted.

As explained in the another embodiment of the present invention, by reducing sectional areas both of the channels 5 and the tubes, as they go from the air inlet side to the air outlet side, the heat transfer between the refrigerant in the channel and the air can be enhanced. Since the heat exchanger having channels 5 of which sectional area ratio and a temperature difference ratio are designed the same has the same refrigerant evaporation rates in the channels 5, flow resistances caused by vaporized refrigerant are almost the same. This is because the refrigerant evaporation rates in the channels 5 are the same, a state of pressure of the lower header 1 at the lower end of each of the channels 5 is the same, and a pressure of the upper header 2 at the upper end of each of the channels 5 is uniform. Hence, every channel 5 has the same pressure.

As has been explained, since the heat exchanger of the present invention has the same pressures in the channels 5 with almost no pressure difference between the channels 5, flow of the refrigerant is smooth and the entire heat exchanger can be utilized more efficiently, thereby permitting fabrication of a smaller heat exchanger with the same capacity.

It will be apparent to those skilled in the art that various modifications and variations can be made in the tube plate structure of a micro-multi channel heat exchanger of the present invention without departing from the spirit or scope of the invention. Thus, it is intended that the present invention cover the modifications and variations of this invention provided they come within the scope of the appended claims and their equivalents.

What is claimed is:

1. A heat exchanger comprising:

a first elongate header for receiving refrigerant;

an second elongate header facing said first header;

a plurality of tubes spaced at intervals from each other along a length direction of said first and second headers, each of said plurality of tubes having a flattened profile and a cross sectional area, taken in a direction parallel to the length direction of said first and second headers, which reduces in width from an air inlet side of said heat exchanger to an air outlet side of said heat exchanger, each of said plurality of tubes having a first end fixed to said first header and a second end fixed to said second header, each of said plurality of tubes including a plurality of channels communicating between said first header and said second header, each of said plurality of channels having a cross sectional area taken in a direction parallel to the length direction of said first and second headers, wherein the cross sectional areas of individual channels reduce from said air inlet side of said heat exchanger to said air outlet side of said heat exchanger; and a plurality of fins between said plurality of tubes for heat exchange with air, wherein the cross sectional areas of individual channels are substantially rectangular.

2. The heat exchanger according to claim 1, wherein the cross sectional areas of individual channels reduce at a substantially constant ratio from said air inlet side of said heat exchanger to said air outlet side of said heat exchanger.

3. The heat exchanger according to claim 2, wherein said substantially constant ratio is set such that a ratio of the cross sectional area of a channel closest to said air inlet side of said heat exchanger relative to a cross sectional area of a channel closet to said air outlet side equals (inlet temperature difference)/(outlet temperature difference), where the inlet temperature difference denotes a temperature difference between flowing air and a surface temperature of said tubes at said air inlet side of said heat exchanger, and the outlet temperature difference denotes a temperature difference between flowing air and a surface temperature of said tubes at said air outlet side of said heat exchanger.

4. The heat exchanger according to claim 1, wherein the substantially rectangular cross sectional areas of said channels have rounded corners for reducing a refrigerant flow resistance.

5. The heat exchanger according to claim 1, wherein the substantially rectangular cross sectional areas of said channels have one side parallel to an air flow direction longer than another side perpendicular to the air flow direction.

6. The heat exchanger according to claim 1, further comprising:

a lead channel formed in each of said tubes facing to said air inlet side of said heat exchanger, said lead channel having a rounded side facing toward said air inlet side of said heat exchanger.

7. The heat exchanger according to claim 6, further comprising:

a last channel formed in each of said tubes facing to said air outlet side of said heat exchanger, said last channel having a rounded side facing toward said air outlet side of said heat exchanger.

8. The heat exchanger according to claim 1, further comprising:

a last channel formed in each of said tubes facing to said air outlet side of said heat exchanger, said last channel having a rounded side facing toward said air outlet side of said heat exchanger.

9. The heat exchanger according to claim 1, wherein a cross sectional area of each tube, parallel to the length direction of said first and second headers, reduces at a fixed ratio as it goes from said air inlet side of said heat exchanger toward said air outlet side of said heat exchanger, such that each tube presents an overall wedge-shaped cross sectional area.

10. The heat exchanger according to claim 1, wherein a shape of said first header is the same as a shape of said second header.

11. The heat exchanger according to claim 10, wherein said first header is lower than said second header, and wherein each of said tubes are spaced from one another at a fixed interval.

12. A heat exchanger comprising:

a first elongate header for receiving refrigerant;

an second elongate header facing said first header;

a plurality of tubes spaced at intervals from each other along a length direction of said first and second headers, each of said plurality of tubes having a flattened profile and a cross sectional area, taken in a direction parallel to the length direction of said first and second headers, which reduces in width from an air inlet side of said heat exchanger to an air outlet side of said heat exchanger, each of said plurality of tubes having a first end fixed to said first header and a second end fixed to said second header, each of said plurality of tubes including a plurality of channels communicating between said first header and said second header, each of said plurality of channels having a cross sectional area taken in a direction parallel to the length direction of said first and second headers, wherein the cross sectional areas of individual channels reduce from said air inlet side of said heat exchanger to said air outlet side of said heat exchanger; and a plurality of fins between said plurality of tubes for heat exchange with air, wherein the cross sectional areas of individual channels are substantially trapezoidal, having one side facing said air inlet side of said heat exchanger longer than another side facing said air outlet side of said heat exchanger.

13. The heat exchanger according to claim 12, wherein the cross sectional areas of individual channels reduce at a substantially constant ratio from said air inlet side of said heat exchanger to said air outlet side of said heat exchanger.

14. The heat exchanger according to claim 13, wherein said substantially constant ratio is set such that a ratio of the cross sectional area of a channel closest to said air inlet side of said heat exchanger relative to a cross sectional area of a channel closet to said air outlet side equals (inlet temperature difference)/(outlet temperature difference), where the inlet temperature difference denotes a temperature difference between flowing air and a surface temperature of said tubes at said air inlet side of said heat exchanger, and the outlet temperature difference denotes a temperature difference between flowing air and a surface temperature of said tubes at said air outlet side of said heat exchanger.

15. The heat exchanger according to claim 12, wherein the substantially trapezoidal cross sectional areas of said channels have rounded corners for reducing a refrigerant flow resistance.

16. The heat exchanger according to claim 12, further comprising:

a lead channel formed in each of said tubes facing to said air inlet side of said heat exchanger, said lead channel having a rounded side facing toward said air inlet side of said heat exchanger.

17. The heat exchanger according to claim 16, further comprising:

a last channel formed in each of said tubes facing to said air outlet side of said heat exchanger, said last channel having a rounded side facing toward said air outlet side of said heat exchanger.

18. The heat exchanger according to claim 12, further comprising:

a last channel formed in each of said tubes facing to said air outlet side of said heat exchanger, said last channel having a rounded side facing toward said air outlet side of said heat exchanger.

19. The heat exchanger according to claim 12, wherein a cross sectional area of each tube, parallel to the length direction of said first and second headers, reduces at a fixed ratio as it goes from said air inlet side of said heat exchanger toward said air outlet side of said heat exchanger, such that each tube presents an overall wedge-shaped cross sectional area.

20. The heat exchanger according to claim 12, wherein a shape of said first header is the same as a shape of said second header, said first header is lower the said second head, and each of said tubes are spaced from one another at a fixed interval.

* * * * *